US007825076B2

(12) United States Patent
Hall

(10) Patent No.: US 7,825,076 B2
(45) Date of Patent: Nov. 2, 2010

(54) METHOD OF REDUCING PARTICULATE EMISSIONS

(75) Inventor: Diane Elsie Hall, Shepperton (GB)

(73) Assignee: BP Oil International Limited, Middlesex (GB)

( * ) Notice: Subject to any disclaimer, the term of this patent is extended or adjusted under 35 U.S.C. 154(b) by 660 days.

(21) Appl. No.: 10/535,076

(22) PCT Filed: Nov. 10, 2003

(86) PCT No.: PCT/GB03/04855

§ 371 (c)(1),
(2), (4) Date: May 13, 2005

(87) PCT Pub. No.: WO2004/046283

PCT Pub. Date: Jun. 3, 2004

(65) Prior Publication Data

US 2006/0035792 A1 Feb. 16, 2006

(30) Foreign Application Priority Data

Nov. 15, 2002 (GB) ..... 0226726.8

(51) Int. Cl.
*C10M 137/10* (2006.01)
*B01D 53/94* (2006.01)
*B01D 53/56* (2006.01)

(52) U.S. Cl. ..... 508/371; 508/363; 423/212; 423/215.5

(58) Field of Classification Search ..... 508/363, 508/371; 423/212, 215.5
See application file for complete search history.

(56) References Cited

U.S. PATENT DOCUMENTS

| | | | | |
|---|---|---|---|---|
| 4,902,487 | A * | 2/1990 | Cooper et al. | 423/215.5 |
| 5,254,275 | A | 10/1993 | Beltzer et al. | |
| 5,320,765 | A * | 6/1994 | Fetterman et al. | 508/192 |
| 5,389,111 | A | 2/1995 | Nikanjam et al. | 44/300 |
| 5,652,201 | A * | 7/1997 | Papay et al. | 508/228 |
| 5,976,201 | A | 11/1999 | Barry et al. | 44/413 |
| 6,150,575 | A | 11/2000 | Angevine et al. | 585/14 |
| 6,187,723 | B1 * | 2/2001 | Holt et al. | 508/364 |
| 6,294,141 | B1 * | 9/2001 | Twigg et al. | 423/213.7 |
| 6,588,393 | B2 * | 7/2003 | Chamberlin et al. | 123/196 R |
| 2001/0001803 | A1 | 5/2001 | Hubbard et al. | 585/14 |
| 2002/0151445 | A1 * | 10/2002 | Curtis et al. | 508/578 |
| 2003/0233785 | A1 | 12/2003 | Weissman et al. | 44/300 |
| 2004/0048753 | A1 * | 3/2004 | Ritchie et al. | 508/232 |
| 2005/0154240 | A1 | 7/2005 | Myburgh et al. | |
| 2005/0279669 | A1 | 12/2005 | Schaberg | |

FOREIGN PATENT DOCUMENTS

| | | |
|---|---|---|
| EP | 1108862 | 6/2001 |
| EP | 0224842 | 3/2002 |
| EP | 1251248 | 10/2002 |
| JP | 10-159552 | 6/1998 |
| JP | 11-324645 | 11/1999 |
| JP | 2002-60776 | 2/2002 |
| JP | 2002-146379 | 5/2002 |
| JP | 2002-212579 | 7/2002 |
| JP | 2003-277781 | 10/2003 |
| JP | 2003-336089 | 11/2003 |
| WO | WO 92/14804 | 9/1992 |
| WO | WO 95/23836 | 9/1995 |
| WO | WO 01/32809 A1 | 5/2001 |
| WO | WO 02/24842 | 3/2002 |
| WO | WO 02/062929 | 8/2002 |
| WO | WO 03/083016 A2 | 10/2003 |
| WO | WO 03/104361 | 12/2003 |

OTHER PUBLICATIONS

Joanna Stevens, "Rush hour air quality study raises questions over UK particulate standards," "Vehicle emissions dominated by nanoparticles," Chemistry World, Jan. 2007, p. 20, UK.

Sarah Corcoran, "Catalysts have chirality forced upon them," "A lasting memory," Chemistry World, Jan. 2007, p. 20, UK.

Tappe, "Fuel Quality in Europe from the Point of View of Environmental Protection," "Mineralöl Technik," Jul. 2000, p cover, 6-9, v 7, Beratungsgesellschaft für Mineralöl-Anwendungstechnik mbH, Germany.

Pahlke, "Influences of Additives and Engine Oil on Specific Vehicle Emissions," Mineralöl Technik, Feb. 2002, p cover, 4-11, v 2, Beratungsgesellschaft füMineralöl-Anwendungstechnik mbH, Germany.

Rob Lee, "Fuel Quality Impact on Heavy Duty Diesel Emissions," SAE Paper 982649, Oct. 19-22, 1998, pp. 1-19.

L. T. Cowley, R. J. Stradling, J. Doyon, "The Influence of Composition and Properties of Diesel Fuel on Particulate Emissions from Heavy Duty Engines," SAE Paper, vol. 932732, 1993, pp. 13-48.

A. Bunting, "Springing the Trap," Automotive Engineer, Mech Eng Publ. vol. 25 (5), pp. 73-74.

(Continued)

*Primary Examiner*—Glenn Caldarola
*Assistant Examiner*—Jim Goloboy
(74) *Attorney, Agent, or Firm*—James R. Henes; Kelly L. Cummings

(57) ABSTRACT

The present invention relates to lubricating oils, and in particular to the use of lubricating oils with low sulphur content in combination with a low sulphur fuel to reduce particulate emissions of a diesel engine equipped with a particulate trap. Thus, there is provided the use of an engine lubricating oil having a low sulphur content in combination with a fuel having a low sulphur content, to reduce the emissions of nucleation mode particles from a diesel engine fitted with a particulate trap. There is also provided a method of reducing the number of nucleation mode particles in the emissions from a diesel engine fitted with a particulate trap, which method comprises using an engine lubricating oil having a low sulphur content in combination with a fuel having a low sulphur content.

32 Claims, 1 Drawing Sheet

OTHER PUBLICATIONS

Math KytÖ, Päivi Aakko, Nils-Olof Nylund, Aapo Niemi, "Effect of Lubricant on Particulate Emissions of Heavy Duty Diesel Engines," Society of Automotive Engineers, [Special Publication] SP (2002), SP-1722 (Lubricants), 127-137.
J.A. McGeehan, E. Shamah, M.C. Couch, R. A. Parker; "Selecting Diesel Crankcase Oils for Low-Sulfur Fuel"; Technische Akademie Esslingen 9th International "Ecological & Economic Aspects of Tribology" Colloquium (Esslingen Jan. 11-13, 1994) Proceedings V1 5.3-1-5.3-24 (1994).
Exploring Low Emission Lubricants for Diesel Engines, Jun. 2000. Full document attached with this Supplemental Form. Previously submitted Cover Page and Title Page Only.
The University of Minnesota, Diesel Aerosol Sampling Methodology and the Mobile Laboratory, Printout Internet Archive, http://web.archive.org/web/20010217041008.
Hamm, "Diesel Exhaust Gas Odour, Project No. 636, Influence of Exhaust Gas Aftertreatment Systems and Fuels on the Exhaust Gas Odour of Directly Injecting Diesel Engines in Stationary and Non-Stationary Mode, Taking Account of the Limited and Selected Non-Limited Exhaust Gas Components." Final Report, Frankfurt am Main: FVV, 1999, pp. 1-133, and an English translation of pp. 72-80 therein.
Diesel Fuel News, Carbon Study Shows Clean-Diesel Beats CNG on PM 'Toxics'; CNG Monopoly Shaken, dated Apr. 29, 2002; pp. 7 and 8.
Diesel Fuel News, CNG Once Again Fails to Beat Clean-Diesel on 'Toxics' dated Mar. 18, 2002; p. 15.
David M. Human, Joel A. Evans, Ethyl Petroleum Additives Inc., Session Code: SFL 19; Room N-7, All Day, dated May 6-9.
Diesel Fuel News, ULSD, Particle Filters 'Do the Right Thing' by Eliminating the Most Mutagenic PM, dated Jun. 10, 2002, V6, n12 p. 7(2).
Tim Sullivan, Lube Report, Industry news from Lubes-n-Greases, Engine Oils Face Costly Changes. vol. 2 Issue 12, 2 pages.
Mineralöl Technik, Pahike, Einflüsse von Additiven and Motorenöl auf spezifische Fahrzeugemissionen; dated Feb. 2002, 11 pages.
Mineralöl Technik, Tappe, Kraftstoffqualitaten in Europa aus der Sicht des Umweltschutzes dated Jul. 2000, 8 pages.
Reference D4A cited in the European Opposition against the European counterpart.
SAE Technical Report 2002-01-1699, May 6-9, 2002.
Translation of pp. 72-80 of reference D25 from the European opposition against the European counterpart.
Exploring Low Emission Lubricants for Diesel Engines, Jun. 2000. (Cover Page and Title Page Only) Other pages to follow in Supplemental IDS.
Letter from Fuchs Europe Schmierstoffe GmbH to Dr. Diane Reinstädler regarding reference D25 cited in the European Opposition against the European counterpart; May 18, 2009.
Letter from Meissner Bolte & Partner GbR to Stephan Held regarding the communication under Rule 79 (3) EPC of Dec. 22, 2008; Jun. 15, 2009.
Hamm, "Diesel Exhaust Gas Smell," Project No. 636, 1999, English translation of document No. 1 on p. 2 of Aug. 20, 2008 IDS.
Mineral Technik, Pahlke, "Influences of Additives and Engine Oil on Specific Vehicle Emissions," Feb. 2002, English translation of document No. C6 on Jun. 4, 2009 IDS.
Mineral Technik, Tappe, "Fuel Qualities in Europe from the Point of View of Environmental Protection," Jul. 2000, English translation of document C7 on Jun. 4, 2009 IDS.
Jacob et al., "The Influence of Lubricating Oil on the Emissions of Diesel Engines with Exhaust After-Treatment," English Translation of document No. 16 on Aug. 20, 2008 IDS.
Voltz, "The Engine Oil in its Conflicting Position between Engine Protection and Catalyst Durability," Jun. 10-11, 2002, English translation of document No. 13 on Aug. 20, 2008 IDS.
Szymkowicz et al., "Effects of Advanced Fuels on the Particulate and NOx Emissions from an Optimized Light-Duty CIDI Engine," SAE Paper No. 2001-01-0148.
Kenny et al., "Overall Results: Phase I Ad Hoc Diesel Fuel Test Program," SAE Paper No. 2001-01-0151.
Fotheringham et al., "Base Oil Effects on Emissions and Fuel Economy in a Heavy-Duty Vehicle Over the European Transient Cycle," SAE Paper 2002-01-2768, from Powertrain and Fluid Systems Conference and Exhibition, San Diego, California, Oct. 21-24, 2002.
Korn, "An Advanced Diesel Fuels Test Program," SAE Paper No. 2001-01-0150.
Gardner et al., "Evaluation of Some Alternative Diesel Fuels for Low Emissions and Improved Fuel Economy," SAE Paper No. 2001-01-0149.
Schaberg et al., "Exhaust Particle Number and Size Distributions With Conventional and Fischer-Tropsch Diesel Fuels," *Society of Automotive Engineers, Inc*., 2002-01-2727, pp. 55-67, (2002).
Schaberg et al., "Diesel Engine Emissions With Sasol Slurry Phase Distillate Fuel," *World Clean Air Congress*., 6F-3, pp. 1-6, (1998).
Hamm, "Diesel Exhaust Gas Odour, Project No. 636, Influence of Exhaust Gas Aftertreatment Systems and Fuels on the Exhaust Gas Odour of Directly Injecting Diesel Engines in Stationary and Non-Stationary Mode, Taking Account of the Limited and Selected Non-Limited Exhaust Gas Components," Final Report, Frankfurt am Main: FVV, 1999, pp. 1-133.
Hamm, et al., "The Effect of Fuel Specifications and Different Aftertreatment Systems on Exhaust Gas Odour and Non-Regulated Emissions at Steady State and Dynamic Operation of DI-Diesel Engines," Society of Automotive Engineers (SAE), 1999-01-3559, pp. 1-13.
Zelenka et al., "Diesel Oxidation Catalyst Application Strategies with Special Emphasis on Odour Reduction," SAE Paper 942066, Oct. 17-20, 1994.
Abdul-Khalek et al., "Diesel Trap Performance: Particle Size Measurements and Trends," SAE Paper 982599, Oct. 19-22, 1998.
Maricq et al., "The Effects of the Catalytic Converter and Fuel Sulfur Level on Motor Vehicle Particulate Matter Emissions: Light Duty Diesel Vehicles," Environ. Sci. Technol., 2002, vol. 36, pp. 283-289.
Kittelson, "Ultrafine Particulate Matter in the Exhaust from Diesel and Gasoline-Powered Mobile Sources," Presented to the Mobile Sources Technical Review Subcommittee, the University of Minnesota, Oct. 13, 1999.
Eastwood, "Critical Topics in Exhaust Gas Aftertreatment," Published by Research Studies Press Ltd., 2000, ISBN 0 86380 242 7, pp. 56-59.
Kyto et al., "Effect of Lubricant on Particulate Emissions of Heavy Duty Diesel Engines," SAE Paper, 2002-01-2770, Presented at the Powertrain & Fluid Systems Conference & Exhibition, Oct. 21-24, 2002.
Mehta et al., "Nanoparticule Emissions from Catalyzed Trap Equipped Heavy-Duty Vehicles Operating on Ultra-Low Sulfur Diesel Fuel," Presented at the 5. ETH Conference on Nanoparticle-Measurement, Aug. 6-9, 2001.
Gautam et al., "Effect of Lubricant Sulfur Levels on Nanoparticle Emissions," Presented at the 5. ETH Conference on Nanoparticle-Measurement, Aug. 6-9, 2001.
Invitation Program of the 5. ETH Conference on Nanoparticle-Measurement, Zurich, Switzerland, Aug. 6-9, 2001.
DOE/EE-0261 ANL/ESD/02-1, Off-Highway Vehicle Technology Roadmap, Dec. 2001.
Voltz, "The Engine Oil in Its Conflicting Position Between Engine Protection and Catalyst Durability," Vortrag vom Jun. 10-11, 2002, pp. 269-375.
University of Minnesota, Department of Mechnical Engineering, "Diesel Aerosol Sampling Methodology—CRC E-43," Final Report, Aug. 19, 2002.
Burtscher, "Literature Study on Tailpipe Particulate Emission Measurement for Diesel Engines," for the Particle Measurement Programme (PMP) for BUWAL/GRPE, Mar. 2001.
Jacob et al., "The Influence of Lubricating Oil on the Emissions of Diesel Engines with Exhaust Aftertreatment," 22 Internationales Wiener Motorensymposium Apr. 26-27, pp. 286-301.
Ullmanns Encyklopadie der technischen Chemie, Band 20, Verlag Chemie GmbH, D-6940 Weinheim, 1981, pp. 540-560.
Automobiltechnisches Handbuch, 2 Band, technischer Verlag Herbert Cram, Berlin, 1953, pp. 147-150.

Tobias et al., "Chemical Analysis of Diesel Engine Nanoparticles Usinga Nano-DMA/Thermal Desorption Particle Beam Mass Spectrometer," Environ. Sci. Technol., vol. 35, 2001, pp. 2233-2243.
Whitacre, "'Catalyst Compatible' Diesel Engine Oils, DECSE Phase II," Jan. 31, 2000, forming Attachment 24 to US DOE Report NREL/SR-570-28521, "Exploring Low Emission Lubricants for Diesel Engines—2000," edited by J.M. Perez, published Jun. 2000.
Peckham, "ULSD Particle Filters 'Do the Right Thing' by Eliminating the Most Mutagenic PM," Diesel Fuel News, Jun. 10, 2002, pp. 7-8.
IOM Report EO7214, dated Dec. 2001, reporting analysis of Kendall Super-D3, including photographs of the container of the commercially available oil.
"Diesel Emission Control—Sulfur Effects (DECSE) Program, Phase I Interim Data, Report No. 1," Aug. 1999, published Nov. 15, 1999.
Cadle et al., "Real-World Vehicle Emissions: A Summary of the Tenth Coordinating Research Council On-Road Vehicle Emissions Workshop," Journal of the Air & Waste Management Association, vol. 51, Feb. 2001, pp. 236-249.
Kittleson et al., "Diesel Aerosol Sampling in the Atmosphere," 10th CRC on Road Vehicle Emission Workshop, San Diego, CA, Mar. 27-29, 2000.
Kittelson et al., "Review of Diesel Particulate Matter Sampling Methods—Final Report," Jan. 14, 1999.
Printout from www.me.umn.edu/centers/cdr/Proj_EPA.html showing the page was last modified May 27, 2000 and providing a link for downloading document 26.
Proceedings of the 10th CRC On-Road Vehicle Emissions Workshop, San Diego, California, Mar. 27-29, 2000 [CD-ROM]—CD available from CRC not later than Feb. 2001 (see reference 30, p. 237, LH column, lines 6-10) including the full text of reference 25.
Photocopy of the original CD provided by CRC since the copy CD provided for this IDS does not show the label found on reference 28.
Printout from Windows Explorer showing the dates of folders and files on the original CD.
Schaberg et al., "Diesel Exhaust Emissions Using Sasol Slurry Phase Distillate Process Fuels," SAE, Inc., Oct. 13-16, 1997, 972898, pp. 123-138.
Morgan et al., "Some Comparative Chemical, Physical and Compatibility Properties of Sasol Slurry Phase Distillate Diesel Fuel," SAE, Inc., Oct. 19-22, 1998, 982488, pp. (9 non-numbered pages).
Payri et al., "Characterisation of the Infection-Combustion Process in a Common Rail D.I. Diesel Engine Running with Sasol Fisher-Tropsch Fuel," CEC and SAE, Inc., 2000-01-1803, pp. 1-10.
Schaberg et al., "Comparative Emissions Performance of Sasol Fischer-Tropsch Diesel Fuel in Current and Older Technology Heavy-Duty Engines," CEC and SAE, Inc., 2000-01-1912, pp. 9.
May et al., "Development of Truck Engine Technologies for Use with Fischer-Tropsch Fuels," SAE, Inc., 2001-01-3520, pp. (13 non-numbered pages).
Zarling et al., "Exhaust Particle Number and Size Distributions with Conventional and Fischer-Tropsch Diesel Fuels," SAE, Inc., 2002-01-2727, pp. 55-67.
Friess et al., "Emissionsverbesserung durch GTL-Dieselkraftstoff Reductions in Exhaust Emissions with GTL Diesel Fuel," VDI-Berichte NR. 1808, 2003, pp. 265-279.

* cited by examiner

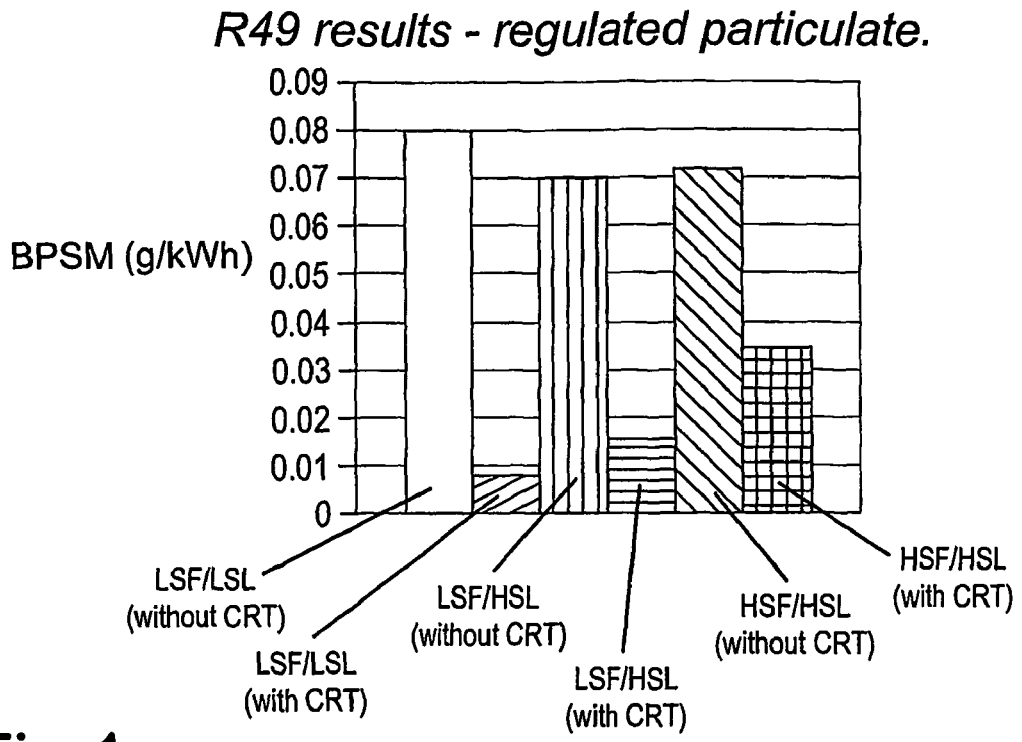
Fig.1 : R49 regulated particulate emissions by mass (g/kWh).
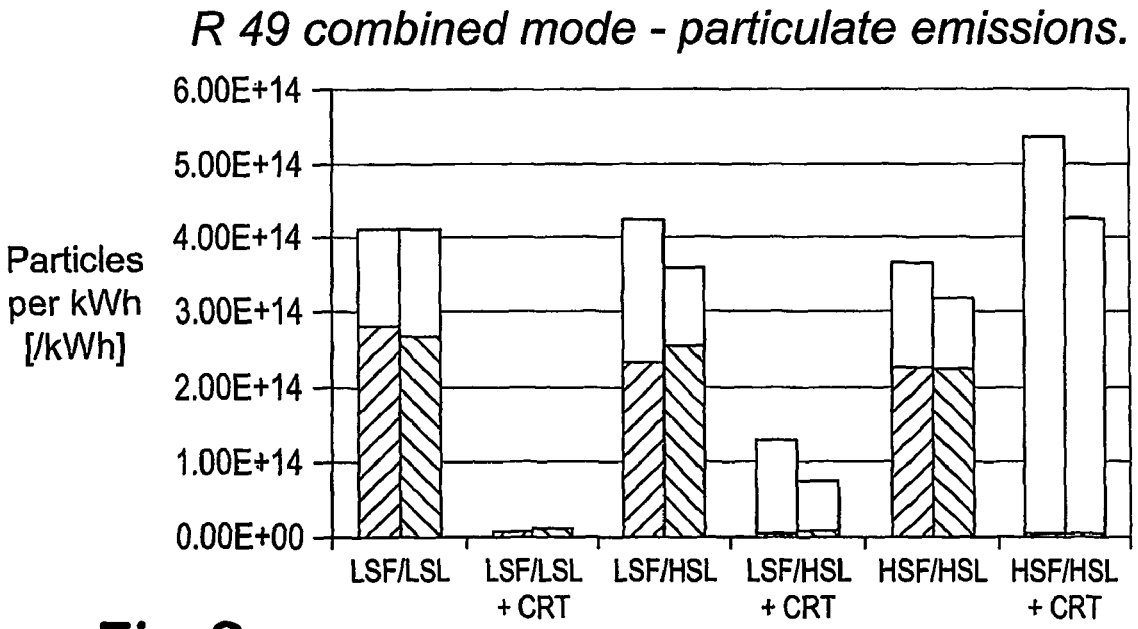
Fig.2 : R49 combined mode total particulate emissions (number/kWh) measured by SPMS (shaded areas) and UPM (open areas).

METHOD OF REDUCING PARTICULATE EMISSIONS

The present invention relates to lubricating oils, and in particular to the use of lubricating oils with low sulphur content in combination with a low sulphur fuel to reduce particulate emissions of a diesel engine equipped with a particulate trap.

Diesel engines are commonly used on private and commercial vehicles, particularly on commercial vehicles such as buses and lorries. It is known that emissions from diesel engines may comprise carbon oxides, nitrogen oxides, sulphur oxides, hydrocarbons and particulates. It is desirable to reduce these emissions either as a whole or individually. Whilst some of the emissions have their origin in the fuel which is combusted in the engine, the lubricating oil which is used to lubricate the engine can also impact on the tail-pipe emissions, for example by direct emission of combustion products of the oil or by affecting the trap performance.

In particular, the particulate emissions from an engine are believed to be related, at least in part, to the sulphur content of the fuel. Thus, in addition to the benefit lower sulphur gives to after-treatment devices, there has been a trend in recent years to reduce sulphur content of internal combustion fuels.

Despite the trend towards low sulphur fuels, with the advent of increasingly stringent particulate emissions controls in many areas of the world, for example, in the EU and USA, such as the particulate emissions limits for vehicles within city limits in states such as California, and states in the north-east of the USA, there may be a requirement for diesel vehicles to be fitted with particulate traps.

Particulate traps have been shown to be effective at trapping particles formed in the combustion process. During the combustion process, and especially in the presence of an oxidation catalyst in a catalysed particulate trap, a percentage of the sulphur in the fuel forms sulphates. Where a particulate trap is present the majority of this should remain in the particulate trap. However, under certain operating conditions, where the temperature of the trap becomes elevated, this material is released and, along with volatile emissions that now come straight through the trap, can condense after the trap to produce large numbers of nucleation mode particles.

These, extremely small, nucleation mode particles typically have a diameter of 30 nm or less, such as in the range of from 1 nm to 30 nm inclusive, for example in the range of from greater than 3 nm to 30 nm inclusive. Although larger carbonaceous particles (accumulation mode particles) make up the majority of the mass of particulate emissions, whilst the nucleation mode particles make up a relatively low mass of particulate emissions, it has been found that these nucleation mode particles can make a significant contribution to the total number of particulates emitted.

It is thus desirable to reduce the number of these nucleation particles emitted.

We have now surprisingly found that the concentration of nucleation mode particle emissions from a diesel engine fitted with a particulate trap may be significantly decreased by use of an engine lubricating oil having a low sulphur content (low sulphur lube oil) in combination with a fuel having a low sulphur content (low sulphur fuel).

Thus, according to the present invention there is provided the use of an engine lubricating oil having a low sulphur content in combination with a fuel having a low sulphur content, to reduce the emissions of nucleation mode particles from a diesel engine fitted with a particulate trap.

It has been found that use of a low sulphur lube oil with a low sulphur fuel according to the present invention causes significantly reduced nucleation mode particulate emissions compared to use of a conventional lube oil with a low sulphur fuel. Surprisingly the reduction in nucleation mode particulate emissions is significantly larger than might be expected based on the reduction in sulphur level of the lube oil alone.

Thus, according to another embodiment of the present invention there is provided a method of reducing the number of nucleation mode particles in the emissions from a diesel engine fitted with a particulate trap, which method comprises using an engine lubricating oil having a low sulphur content in combination with a fuel having a low sulphur content.

The present invention is particularly useful wherein the particulate trap is a catalysed particulate trap, which comprises both an oxidation catalyst and a filter. An example of such a trap is a continuously regenerating trap (CRT™). In the combustion of a fuel the majority of any sulphur present is converted to sulphur dioxide, with a relatively small amount, typically 1-2%, being converted to sulphates. These sulphates may act as precursors for particulate formation. In the presence of a particulate filter, but the absence of an oxidation catalyst, the gas formed from combustion of the fuel (and lube oil) contacts the filter, which will remove at least some of the particles formed from the gas. However the trapped particles may quickly block the filter, and to burn the particles off (as $CO_2$) requires very high temperatures, not normally reached in the trap. In a catalysed particulate trap, as well as the filter there is also provided an oxidation catalyst. The gas first contacts the oxidation catalyst, wherein, for example, components such as sulphur dioxide in the gas are oxidised to sulphates. The oxidised gas then contacts the filter, which can trap the particulates. In a continuously regenerating trap, at least some of the particulates trapped are burnt off from the filter by reaction with oxidation products from the catalyst, such as nitrogen dioxide (which is formed by oxidation of $NO_x$ species in the combustion gas). These reactions occur at lower temperatures than those that would otherwise be required to bum the particulates off, and at temperatures that can be reached in the traps fitted to diesel engines, and hence the trap is continuously regenerated. However, sulphates are not burned off, but are re-volatilised at high temperatures, thus providing the potential to re-form as particles post-trap.

The diesel engine may be any suitable diesel engine but is preferably a heavy duty diesel engine.

The low sulphur fuel preferably has a sulphur content below 100 ppm (by weight), such as below 50 ppm. More preferably the sulphur content of the fuel is below 20 ppm, and most preferably is 10 ppm or lower.

The low sulphur lube oil preferably has a sulphur content of less than 0.4% (by weight), such as less than 0.3%. More preferably the lube oil has a sulphur content of less than 0.2%, and most preferably less than 0.15%.

A known additive used in lubricating oils for lubricating diesel engines engine is zinc dialkyl dithiophosphate (ZDDP). This is used as an anti-wear, anti-oxidant and corrosion inhibitor additive. However, this additive contains sulphur. Therefore according to another aspect of the present invention the lubricating oil has a ZDDP content at most 0.8% by weight, preferably at most 0.4% by weight, and more preferably is substantially free of ZDDP.

The lubricating oil may comprise one or more anti-wear additives which might be used, at least in part, to replace ZDDP, such as anti-wear additives selected from the group consisting of (a) molybdenum containing compounds, such as molybdenum dithiocarbamate (MoDTC), molybdenum dithiophosphate and molybdenum amines (b) organic based friction modifiers, such as oleamides, acids, amines, alcohols, phosphate esters and glycerol monooleates, and (c) salicylate-type detergents, such as calcium salicylate and magnesium salicylate.

The lubricating oil may comprise one or more anti-oxidant additives which might be used, at least in part, to replace ZDDP. Preferably at least one of the anti-oxidant additives may be selected from the group consisting of aromatic amines or phenolic compounds, such as hindered phenols.

The lubricating oil may comprise one or more corrosion inhibitor additives which might be used, at least in part, to replace ZDDP. Preferably, the corrosion inhibitor additives may be selected from conventional non-sulphur detergent additives.

The lubricating oil may comprise one or more other additives which may be known to one skilled in the art as lubricating oil additives. Such additives may include one or more of anti-foam additives, Viscosity Index improvers and dispersants.

The invention will now be illustrated with respect to the following Examples, and the figures, in which:

FIG. 1 shows the particulate emissions by mass (in g/k Wh) according to the standard ECE Reg. 49 test, for combinations of low and high sulphur fuels (LSF and HSF), and low and high sulphur lube oils (LSL and HSL), in the presence and absence of the CRT.

FIG. 2 shows the data for total particulate emissions (number/k Wh) for combinations of low and high sulphur fuels, and low and high sulphur lube oils measured using both a Scanning Mobility Particle Sizer (SMPS) and an Ultrafine Particulate Monitor (UPM).

EXAMPLES

Tests were performed on a Heavy Duty (HD) diesel engine (11 litre (21/cyl), turbo-charged/intercooled diesel engine fitted with electronic fuel injection equipment)

Two different fuels were tested. Fuel 1 was a low sulphur fuel comprising 10 ppm sulphur and corresponding to EN-590 specification. Fuel 2 was a high sulphur fuel and was produced by doping a sample of fuel 1 to 50 ppm sulphur.

Two lubricants were tested. The first was a conventional lube oil comprising 0.75 wt % sulphur, supplied by Castrol, herein designated as "high sulphur". The second was a low sulphur synthetic based SAE 5W-30 lube oil comprising 0.14 wt % sulphur, in which the ZDDP level was reduced compared to the conventional lube oil, to give a ZDDP level of 0.38 wt %, and oleamide was added as an additional antiwear additive.

Tests were performed both with and without a Continuously Regenerating Trap (CRT), supplied by Johnson Matthey.

Particle size measurement was made with both a TSI 3071 Scanning Mobility Particle Sizer (SMPS) (scanning between 7-320 nm), and a Booker Systems Ultrafine Particulate Monitor (UPM) (giving total particle count>3 nm)

Tests were performed under the ECE Reg. 49 testing conditions. For engines built prior to 2000 this is the standard homologation test for heavy duty diesel engines in Europe.

The R49 test cycle requires the engine to be tested over 13 steady-state modes at based at different speed/load operating conditions. The emissions in each mode are measured and aggregated according to a regulated procedure to give a single result for the cycle. For particle emissions the standard test method measures the mass of particles produced in each mode. The result therefore gives an aggregated total mass of particles produced per k Wh of power.

In the examples given, the total number of particulate emissions was measured using both a standard Scanning Mobility Particle Sizer (SMPS) (scanning between 7-320 nm), and an Ultrafine Particulate Monitor (UPM) (giving total particle count >3 nm). These results were then aggregated to give a combined mode particle emission value for the R49 cycle in number of particles per k Wh. The aggregation was performed in the same manner as for the regulated procedure for mass of particulate emissions the R49 test.

For comparison, FIG. 1 gives the particle emissions measured as particle mass (in g/k Wh) according to the standard ECE Reg. 49 test, for combinations of the low and high sulphur fuels (LSF and BSF), and the low and high sulphur lube oils (LSL and HSL), in the presence and absence of the CRT.

It can be seen that in the absence of a CRT the emissions, in terms of particle mass, are approximately similar. Significant changes in mass emission in the absence of the trap would not be expected as only a small proportion of the sulphur in the fuel is emitted as particulates, and the changes in sulphur level will have only a small impact on regulated emissions. However in the presence of the CRT, due to the presence of the oxidation catalyst, the total mass of particles produced is more dependent on the sulphur levels in the lube oil and fuel and reduces as the sulphur levels in the lube oil and fuel are decreased.

FIG. 2 shows the data for total particle emission rates (number/k Wh) for the 10 ppm and 50 ppm sulphur fuels with the two lubricants measured using both SPMS and UPM. The two bars for each set represent repeat experiments showing high reproducibility.

The shaded bars represent the SMPS measurement and the clear bars represent the UPM measurement, the difference between the shaded bars and the open bars being the small particles detected by the UPM (but not the SMPS) i.e. nucleation mode particles of between about 3 and 7 nm diameter.

It can be seen that with the 50 ppm sulphur fuel and high sulphur lube oil then essentially all the accumulation mode particles are removed from the emissions by the presence of the trap (CRT), but a larger number of nucleation mode particles are emitted compared to the test in the absence of the CRT. This increase is at least in part, dud to reaction of sulphur dioxide on the oxidation catalyst in the CRT to produce sulphates, which are emitted from the CRT under the conditions in certain modes of the R49 test.

For a low sulphur fuel with the high sulphur lube oil it can be seen that in the absence of a trap the total particle emissions are very similar to those for the high sulphur fuel, as may be expected by comparison with FIG. 1. Again this, is due to the fact that in the absence of the trap only a small proportion of the sulphur in the fuel is emitted as particulates. In the presence of a trap, essentially all of the accumulation mode particles are removed from the emissions, as seen for the high sulphur fuel. In this case the total number of nucleation mode particles produced decreases compared to the high sulphur fuel.

For the low sulphur lube oil with a low sulphur fuel the emissions in the absence of the CRT are again similar to those seen for the experiments with the high sulphur lube oil and the low sulphur and high sulphur fuels respectively, as expected. However the use of a low sulphur lube oil with a low sulphur fuel in the presence of the CRT gives total particulate emissions that are very significantly lower than expected based on the reduction in the sulphur level.

In particular the use of a low sulphur lube oil in combination with a low sulphur diesel fuel leads to a reduction in the emissions of nucleation mode particles from a diesel engine fitted with a particulate trap.

The invention claimed is:

1. A method of reducing the number of nucleation mode particles in the emissions from a heavy duty diesel engine fitted with a catalyzed particulate trap, which is a continuously regenerating trap (CRT™) comprising both an oxidation catalyst and a particulate trap, which method comprises lubricating a heavy duty diesel engine with a lubricating oil consisting essentially of an anti-wear, anti-oxidant and corrosion-inhibiting lubricating oil having a low sulphur content of less than 0.4% by weight and comprising ZDDP and optionally at least one additional additive selected from the group consisting of an anti-wear additive, an anti-oxidant additive, a corrosion inhibitor, an anti-foam additive, a Viscosity Index improver and a dispersant, wherein ZDDP is present at a concentration of up to 0.4 percent by weight, and employing a fuel having a low sulphur content of below 50 ppm by weight, to thereby reduce the emissions of nucleation mode particles from the heavy duty diesel engine fitted with a catalyzed particulate trap, wherein the nucleation mode particles have a diameter in the range of between about 3 nm and 7nm.

2. A method according to claim 1, wherein the sulphur content (by weight) of the fuel is below 20 ppm.

3. A method according to claim 2, wherein the sulphur content (by weight) of the fuel is 10 ppm or lower.

4. A method according to claim 1, wherein the low sulphur lubricating oil has a sulphur content (by weight) of less than 0.3%.

5. A method according to claim 4, wherein the low sulphur lubricating oil has a sulphur content (by weight) of less than 0.2%.

6. A method according to claim 5, wherein the low sulphur lubricating oil has a sulphur content (by weight) of less than 0.15%.

7. A method according to claim 1, wherein the low sulphur lubricating oil comprises one or more anti-wear additives selected from the group consisting of (a) molybdenum containing compounds, (b) organic based friction modifiers, and (c) salicylate-type detergents.

8. A method according to claim 1, wherein the low sulphur lubricating oil comprises one or more anti-oxidant additives selected from the group consisting of aromatic amines and phenolic compounds.

9. A method according to claim 1, wherein the low sulphur lubricating oil comprises one or more corrosion inhibitor additives selected from the non-sulphur detergent additives.

10. A method according to claim 1, wherein the low sulphur lubricating oil comprises one or more other additives selected from one or more of anti-foam additives, Viscosity Index improvers and dispersants.

11. A method according to claim 2 wherein the low sulphur lubricating oil has a sulphur content (by weight) of less than 0.3%.

12. A method according to claim 3 wherein the low sulphur lubricating oil has a sulphur content (by weight) of less than 0.3%.

13. A method according to claim 2 wherein the low sulphur lubricating oil has a sulphur content (by weight) of less than 0.2%.

14. A method according to claim 3 wherein the low sulphur lubricating oil has a sulphur content (by weight) of less than 0.2%.

15. A method according to claim 2 wherein the low sulphur lubricating oil has a sulphur content (by weight) of less than 0.15%.

16. A method according to claim 3 wherein the low sulphur lubricating oil has a sulphur content (by weight) of less than 0.15%.

17. A method according to claim 2, wherein the low sulphur lubricating oil comprises one or more anti-wear additives selected from the group consisting of (a) molybdenum containing compounds, (b) organic based friction modifiers, and (c) salicylate-type detergents.

18. A method according to claim 2, wherein the low sulphur lubricating oil comprises one or more anti-oxidant additives selected from the group consisting of aromatic amines and phenolic compounds.

19. A method according to claim 2, wherein the low sulphur lubricating oil comprises one or more corrosion inhibitor additives selected from the non-sulphur detergent additives.

20. A method according to claim 2, wherein the low sulphur lubricating oil comprises one or more other additives selected from one or more of anti-foam additives, Viscosity Index improvers and dispersants.

21. A method according to claim 3, wherein the low sulphur lubricating oil comprises one or more anti-wear additives selected from the group consisting of (a) molybdenum containing compounds, (b) organic based friction modifiers, and (c) salicylate-type detergents.

22. A method according to claim 3, wherein the low sulphur lubricating oil comprises one or more anti-oxidant additives selected from the group consisting of aromatic amines and phenolic compounds.

23. A method according to claim 3, wherein the low sulphur lubricating oil comprises one or more corrosion inhibitor additives selected from the non-sulphur detergent additives.

24. A method according to claim 3, wherein the low sulphur lubricating oil comprises one or more other additives selected from one or more of anti-foam additives, Viscosity Index improvers and dispersants.

25. A method according to claim 14, wherein the low sulphur lubricating oil comprises one or more anti-wear additives selected from the group consisting of (a) molybdenum containing compounds, (b) organic based friction modifiers, and (c) salicylate-type detergents.

26. A method according to claim 14, wherein the low sulphur lubricating oil comprises one or more anti-oxidant additives selected from the group consisting of aromatic amines and phenolic compounds.

27. A method according to claim 14, wherein the low sulphur lubricating oil comprises one or more corrosion inhibitor additives selected from the non-sulphur detergent additives.

28. A method according to claim 14, wherein the low sulphur lubricating oil comprises one or more other additives selected from one or more of anti-foam additives, Viscosity Index improvers and dispersants.

29. A method according to claim 16, wherein the low sulphur lubricating oil comprises one or more anti-wear additives selected from the group consisting of (a) molybdenum containing compounds, (b) organic based friction modifiers, and (c) salicylate-type detergents.

30. A method according to claim 16, wherein the low sulphur lubricating oil comprises one or more anti-oxidant additives selected from the group consisting of aromatic amines and phenolic compounds.

31. A method according to claim 16, wherein the low sulphur lubricating oil comprises one or more corrosion inhibitor additives selected from the non-sulphur detergent additives.

32. A method according to claim 16, wherein the low sulphur lubricating oil comprises one or more other additives selected from one or more of anti-foam additives, Viscosity Index improvers and dispersants.

* * * * *